US005377755A

United States Patent [19]

Michaels et al.

[11] Patent Number: 5,377,755

[45] Date of Patent: Jan. 3, 1995

[54] METHOD AND APPARATUS FOR ACQUIRING AND PROCESSING SUBSURFACE SAMPLES OF CONNATE FLUID

[75] Inventors: John M. Michaels, Houston; John T. Leder, Bellaire; James T. Cernosek, Missouri City, all of Tex.

[73] Assignee: Western Atlas International, Inc., Houston, Tex.

[21] Appl. No.: 228,740

[22] Filed: Apr. 18, 1994

Related U.S. Application Data

[63] Continuation-in-part of Ser. No. 976,488, Nov. 16, 1992, Pat. No. 5,303,775.

[51] Int. Cl.[6] ..... E21B 49/00

[52] U.S. Cl. ..... 166/264

[58] Field of Search ..... 166/264; 175/20, 40, 175/58, 59; 73/155, 863, 864.62

[56] References Cited

U.S. PATENT DOCUMENTS

| | | | |
|---|---|---|---|
| 4,940,088 | 7/1990 | Goldschild | 166/264 X |
| 5,289,875 | 3/1994 | Stokley et al. | 166/264 |
| 5,303,775 | 4/1994 | Michaels et al. | 166/264 |
| 5,337,822 | 8/1994 | Massie et al. | 166/264 |

*Primary Examiner*—Michael Powell Buiz

*Attorney, Agent, or Firm*—James L. Jackson; Darryl M. Springs

[57] ABSTRACT

A method and apparatus for downhole formation testing is provided for acquisition of a phase intact sample of connate fluid by direct or indirect pumping for filling of pressure containing sample tanks that are removable from a formation testing and sampling instrument for phase intact transportation to a laboratory facility. One or more fluid sample tanks contained within the instrument are filled with connate fluid samples in such manner that during filling of the sample tanks the pressure of the connate fluid is maintained within the predetermined range above the bubble point of the fluid sample. The sample tank incorporates an internal free-floating piston which separates the sample tank into sample containing and pressure evacuation chambers. During indirect pumping a positive displacement piston pump draws fluid from the pressure evacuation chamber and permits formation pressure to shift the separator piston as the first variable volume chamber is filled with a connate fluid sample. The sample tank is provided with a cut-off valve enabling the pressure of the fluid sample to be maintained after the formation testing instrument has been retrieved from the well bore for transportation to a laboratory facility. To compensate for pressure decrease upon cooling of the sample tank and its contents, the piston pump mechanism of the instrument has the capability during direct pumping for increasing the pressure of the sample sufficiently above the bubble point of the sample that any pressure reduction that occurs upon cooling will not decrease the pressure of the fluid sample below its bubble point.

24 Claims, 4 Drawing Sheets

180
182
190
188
192
200
202
211
216
212
214
FORMATION
F
WB
230
231
WB
184
196
198
185
288
204
210
F
WB
194
206
232
220
218
234
189
224
228
WB
229
226
P1
P2
248
109
111
107
252
240
186
246
236
244
242
254
250
238
191
P1
226
P2
248
109
111
107
252
240
186
246
236
244
242
254
250
238

METHOD AND APPARATUS FOR ACQUIRING AND PROCESSING SUBSURFACE SAMPLES OF CONNATE FLUID

This is a continuation-in-part of U.S. patent application Ser. No. 07/976,488 of John M. Michaels and John T. Leder, filed on Nov. 16, 1992, now U.S. Pat. No. 5,303,775 and entitled Method and Apparatus for Acquiring and Processing Subsurface Samples of Connate Fluid.

FIELD OF THE INVENTION

This invention relates generally to a method and apparatus for subsurface formation testing, and more particularly concerns a method and apparatus for taking samples of connate fluid at formation pressure retrieving the samples and transporting them to a laboratory for analysis while maintaining formation pressure. Even more specifically, the present invention concerns sample vessels that are utilized in conjunction with in situ multi-testing of subsurface earth formation wherein the sample vessels are removably assembled with multi-testing instruments and are separable from such instruments for transportation separately to a suitable site for laboratory analysis or for on-site analysis. This invention is also directed to a subsurface formation testing and sampling instrument and its method of use having the capability for selective "direct" or "indirect" pumping or movement of connate fluid from the formation of interest into the sample chamber of one or more sample tanks of the instrument. Even further, this invention concerns the provision in a downhole multi-tester instrument of two or more fluid pumping units which provide the capability for selective pumping of multiple fluids such as injection fluids, completion fluids, well bore fluids and connate fluid samples.

BACKGROUND OF THE INVENTION

The sampling of fluids contained in subsurface earth formations provides a method of testing formation zones of possible interest by recovering a sample of any formation fluids present for later analysis in a laboratory environment while causing a minimum of damage to the tested formations. The formation sample is essentially a point test of the possible productivity of subsurface earth formations. Additionally, a continuous record of the control and sequence of events during the test is made at the surface. From this record, valuable formation pressure and permeability data as well as data determinative of fluid compressibility, density and relative viscosity can be obtained for formation reservoir analysis.

Early formation fluid sampling instruments such as the one described in U.S. Pat. No. 2,674,313 were not fully successful as a commercial service because they were limited to a single test on each trip into the borehole. Later instruments were suitable for multiple testing; however, the success of these testers depended to some extent on the characteristics of the particular formations to be tested. For example, where earth formations were unconsolidated, a different sampling apparatus was required than in the case of consolidated formations.

Down-hole multi-tester instruments have been developed with extensible sampling probes for engaging the borehole wall at the formation of interest for withdrawing fluid samples therefrom and measuring pressure. In downhole instruments of this nature it is typical to provide an internal draw-down piston which is reciprocated hydraulically or electrically to increase the internal volume of a fluid receiving chamber within the instrument after engaging the borehole wall. This action reduces the pressure at the instrument/formation interface causing fluid to flow from the formation into the fluid receiving chamber of the tool or sample tank. Heretofore, the pistons have accomplished suction activity only while moving in one direction. On the return stroke the piston simply discharges the formation fluid sample through the same opening through which it was drawn and thus provides no pumping activity. Additionally, unidirectional piston pumping systems of this nature are capable of moving the fluid being pumped in only one direction and thus causes the sampling system to be relatively slow in operation.

Early down-hole multi-tester instruments were not provided with a capacity for substantially continuous pumping of formation fluid. Even large capacity tools have heretofore been limited to a maximum draw-down collection capability of only about 1000 cc and they have not heretofore had the capability of selectively pumping various fluids to and from the formation, to and from the borehole, from the borehole to the formation, or from the formation to the borehole. U.S. Pat. No. 4,513,612 describes a Multiple Flow Rate Formation Testing Device and Method which allows the relatively small volume drawdown volume to be discharged into the wellbore or to be forced back into the formation. The use of "passive" valves as taught in this method precludes reverse flow. This method does provide for limited or one shot reverse flow much like a hypodermic needle but transferring large volumes of fluid between two reservoirs in a near continuous manner is not achievable with this method. It is desirable, therefore, to provide a down-hole fluid sampling tool with enhanced pumping capability with an unlimited capacity for discharge of formation fluid into the wellbore and with the capability to achieve bi-directional fluid pumping to enable a reverse flow activity that permits fluid to be transferred to or from a formation. It is also desirable to provide a down-hole testing instrument having the capability of selectively pumping differing fluids such as formation fluid, known oils, known water, known mixtures of oil and water, known gas-liquid mixtures, and/or completion fluid to thereby permit in situ determination of formation permeability, relative permeability and relative viscosity and to verify the effect of a selected formation treatment fluid on the producibility of connate fluid present in the formation.

In all cases known heretofore, down-hole multi-test sampling apparatus incorporates a fluid circuit for the sampling system which requires the connate fluid extracted from the formation, together with any foreign matter such as fine sand, rocks, mud-cake, etc. encountered by the sampling probe, to be drawn into a relatively small volume chamber and which is discharged into the borehole when the tool is closed as in U.S. Pat. No. 4,416,152. Before closing, a sample can be allowed to flow into a sample tank through a separate but parallel circuit. Other methods provide for the sample to be collected through the same fluid circuit.

U.S. Pat. No. 3,813,936 describes a "valve member 55" in column 11, lines 10–25 which forces trapped wellbore fluids in a "reverse flow" through a screen member as the "valve member 55" is retracted. This limited volume reverse flow is intended to clean the screen member and is not comparable to bi-directional flow described in this disclosure because of the limited volume.

Mud filtrate is forced into the formation during the drilling process. This filtrate must be flushed out of the formation before a true, uncontaminated sample of the connate fluid can be collected. Prior art sampling devices have a first sample tank to collect filtrate and a second to collect connate fluid. The problem with this procedure is that the volume of filtrate to de removed is not known. For this reason it is desirable to pump formation fluid that is contaminated with filtrate from the formation until uncontaminated connate fluid can be identified and produced. Conventional down-hole testing instruments do not have an unlimited fluid pumping capability and therefore cannot ensure complete flushing of the filtrate; contaminant prior to sampling.

Estimates of formation permeability are routinely made from the pressure change produced with one or more draw-down piston. These analyses require that the viscosity of the fluid flowing during pumping be known. This is best achieved by injecting a fluid of known viscosity from the tool into the formation and comparing its viscosity with recovered formation fluid. The permeability determined in this manner can then be reliably compared to the formations in off-site wells to optimize recovery of fluid.

A reversible pump direction will also allow a known fluid to be injected from the tool or borehole into the formation. For example, treatment fluid stored within an internal tank or compartment of the instrument or drawn from the wellbore may be injected into the formation. After injection, additional draw-downs and/or sampling may take place to determine the effect of the treatment or completion fluid on the producibility of the formation. Early formation sampling instruments have not been provided with features to determine the optimum sampling pressures. The present invention also provides a positive method for overcoming differential sticking of the packer by pumping fluid into the formation at a high pressure to thereby unseat the packer.

The present invention overcomes the deficiencies of the prior art by providing method and apparatus for achieving in situ pressure, volume and temperature (PVT) measurement through utilization of a double-acting, bi-directional fluid control system incorporating a double-acting bi-directional piston pump capable of achieving pumping activity at each direction of its stroke and capable through valve stroke to achieve bi-directional fluid flow and having the capability of selectively discharging acquired connate fluid into the wellbore or into sample containing vessels or pumping fluid from the wellbore or a sample containing vessel into the formation. The connate fluid samples are acquired in such manner that the sample does not undergo phase separation at any point in the sample acquisition process.

At times it is desirable to accomplish "direct" pumping of a connate fluid sample into the sample chamber of a sample tank especially where the sample is to be elevated in pressure above formation pressure. At other times it is desirable to accomplish "indirect" pumping of the connate fluid wherein the fluid is induced to flow from the formation into the sample chamber of the sample tank at or as close as possible to formation pressure. It is desirable therefore to provide a subsurface testing and sampling instrument having the capability of selectively accomplishing connate fluid collection by direct or indirect pumping activity and to accomplish selecting of the pumping mode of the instrument while it is located in the downhole environment.

Especially in cases where differing fluids are to be pumped, such as connate fluid, well bore fluid, completion fluid, etc., it may be desirable that the multi-tester instrument have two or more; independently actuatable pumps. Fluids which should be maintained separate from one another may be pumped in this manner. Also, should a pump unit fail to operate for any reason, another pump unit of the instrument could be activated in its place without necessitating removal of the instrument from the bore hole so that the downhole testing and sampling procedure can be efficiently completed.

SUMMARY OF THE INVENTION

It is a principle feature of the present invention to provide a novel method for acquisition of connate fluid sample from a subsurface earth formation, for retrieving the sample to the surface and providing a safe pressure vessel for transporting it to a suitable laboratory for analysis, while maintaining formation pressure.

It is another feature of this invention to provide a subsurface testing and sampling instrument having the selective capability for direct or indirect pumping for filling of the sample tanks thereof.

It is also a feature of this invention to provide a novel method and apparatus for acquisition of a fluid sample from a subsurface earth formation, controlling the sampling pressure as desired, and then retrieving the connate fluid sample and conducting it to a suitable laboratory for analysis while maintaining the modified pressure of the sample.

It is an even further feature of this invention to provide a novel method and apparatus for acquiring and retrieving connate samples from subsurface earth formations wherein apparatus for acquisition of the sample constitutes a component part of a downhole multi-tester instrument incorporating a removable sample vessel or tank within which the sample fluid may be retrieved and transported to a laboratory site for analysis while maintaining the fluid sample under predetermined pressure exceeding the bubble point pressure of the fluid sample.

It is also a feature of this invention to provide for measurement of piston movement and the speed of piston movement of the pump or pumps of the subsurface testing and measuring instrument so that volumetric pumping and volumetric rate of pumping can be effectively controlled and thus the pressure condition of the connate fluid sample can be controlled, such as to prevent phase separation thereof.

It is another feature of this invention to provide a novel method and apparatus for acquiring a sample of connate fluid from a subsurface formation, at formation temperature and overpressuring the fluid sample within a sample retrieving vessel so that the connate sample will maintain a pressure above the sample's bubble point in order to avoid phase separation after the sample vessel and sample have cooled to surface temperature.

It is also a feature of this invention to provide a subsurface multi-tester instrument incorporating a plurality of internal pumps which enable selective pumping and redundant pump selection as well as providing for the selective pumping of multiple fluids into or from the formation or well bore.

Briefly, the various features of the present invention are effectively realized through the provision of a down-hole formation testing instrument which, in addition to having the capability of conducting a variety of predetermined down-hole tests of the formation and formation fluid, is adapted to retrieve and contain at least one sample of the connate fluid which will be transported to the surface along with the formation testing instrument. Thereafter, the sample, being contained under formation pressure or a pressure exceeding formation pressure is separated from the testing instrument and is conducted to a suitable laboratory for laboratory analysis.

To accomplish these features, the formation testing instrument incorporates a sample taking section defining at least one and preferably a plurality of sample container receptacles. Each of these receptacles releasably contain a sample vessel or tank which is coupled to respective fluid conducting passages of the instrument body. The sample is withdrawn from the formation by the sampling probe of the instrument and is then transferred into the sample vessel by hydraulically energized bi-directional positive displacement piston pump that is incorporated within the instrument body. In order to facilitate filling of the sample tank with connate fluid without reducing the pressure of the fluid at any point in the sample gathering procedure below the bubble point of the connate fluid. The sample tank is pressure balanced with respect to borehole pressure at formation level prior to its filing. Thus the connate fluid contains its original phase characteristics as the sample tank is filled. After filling of the sample tank, in order to compensate for cooling of the sample tank and its contents after it has been withdrawn from the wellbore to the surface and perhaps conducted to a remote laboratory facility for investigation, the piston pump has the capability of overpressuring the fluid sample to a level well above the bubble point of the sample. The hydraulically energized piston pump that accomplishes filling of the sample tank with the sample fluid is controlled to increase the pressure of the connate fluid within the sample tank such that upon cooling of the sample tank and its contents, the connate fluid sample will be maintained at a pressure exceeding formation pressure. This feature compensates for temperature changes and prevents phase separation of the connate fluid as a result of cooling of the sample tank and its contents.

The multi-tester instrument includes one or more internal pumps and associated control circuitry which permits the flexibility of selective "direct" pumping, where formation fluid is drawn from the formation and pumped directly into a sample tank and selective "indirect" pumping, where the pressure of an internal sample tank chamber is lowered, thus permitting filling of the sample chamber of the tank by formation fluid solely responsive to the influence of formation pressure. As the sample chamber is filled, a free piston within the sample tank will be moved by formation pressure until it comes into contact with an internal end wall or other internal stop of the sample tank.

After the sample tank has been withdrawn from the wellbore, along with the formation testing instrument, the pressure within the fluid supply passage from the instrument pump to the sample tank is maintained at the preestablished pressure level until a manually operable tank valve is closed. Thereafter, the pump supply line is vented to relieve pressure upstream of the closed sample tank valve. After this has been accomplished, the sample tank and its contents can be removed from the instrument body simply by unthreading a few hold-down bolts. The sample tank is thus free to be withdrawn from the instrument body and provided with protective end closures, thus rendering it to a condition that is suitable for shipping to an appropriate laboratory facility.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a pictorial illustration including a block diagram schematic which illustrates a formation testing instrument constructed in accordance with the present invention being positioned at formation level within a wellbore, with its sample probe being in communication with the formation for the purpose of conducting tests and acquiring one or more connate samples.

FIG. 2 is a schematic illustration of a portion of downhole formation multi-tester instrument which is constructed in accordance with the present invention and which illustrates schematically a piston pump and a pair of sample tanks within the instrument.

FIG. 3 is a schematic illustration of a bi-directional hydraulically energized positive displacement piston pump mechanism and the pump pressure control system thereof.

FIG. 4 is a schematic illustration of a bi-directional piston pump and check valve circuit that represents an alternative embodiment of this invention.

FIG. 5 is a sectional view of a pressurized sample tank assembly that is constructed in accordance with the present invention.

FIG. 6 is a schematic illustration of a bi-directional pump and sample tank assembly representing the preferred embodiment of the present invention.

DETAILED DESCRIPTION OF PREFERRED EMBODIMENT

Figure 1:
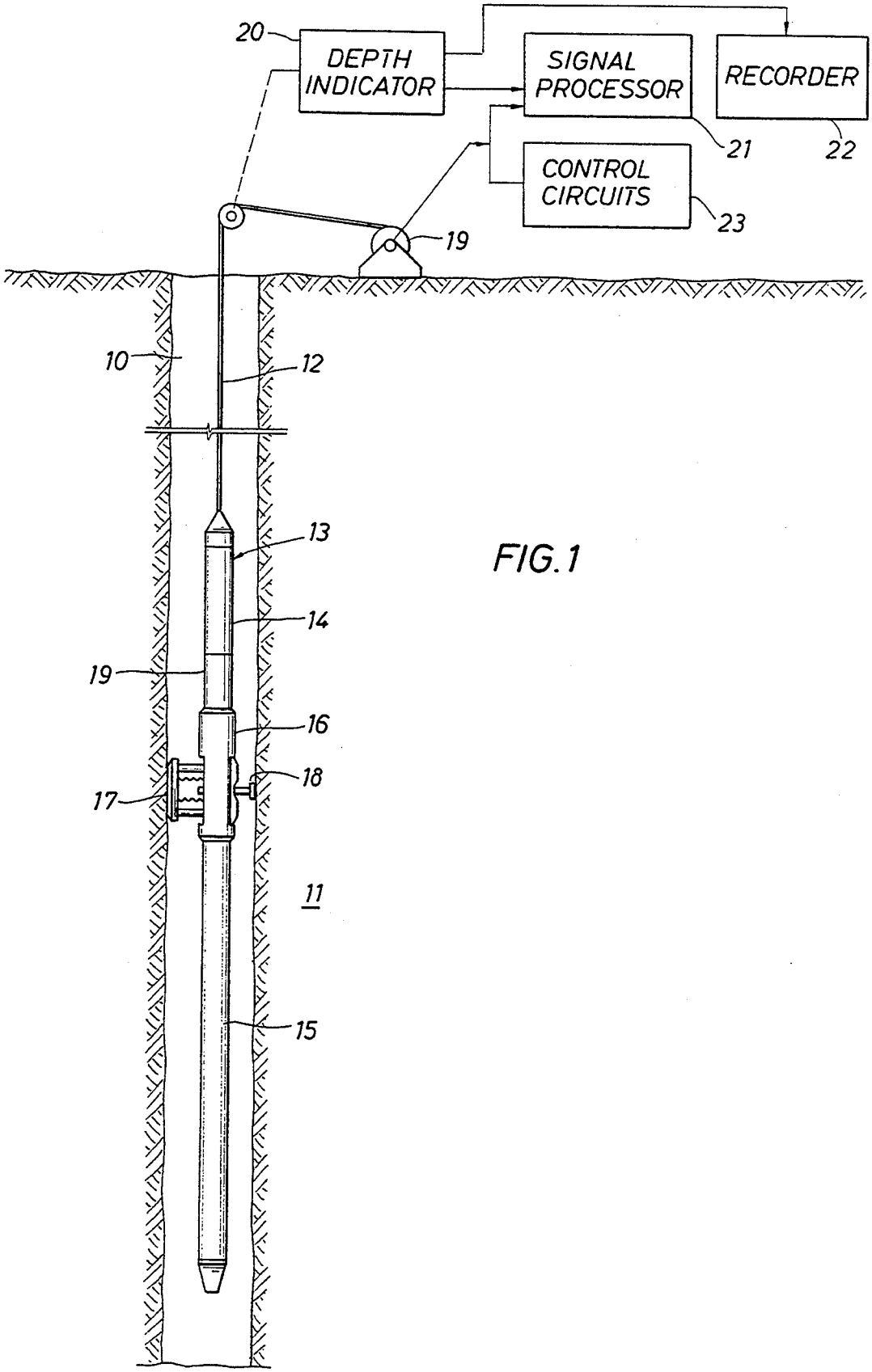

Referring now to the drawings in more detail, particularly to FIG. 1, there is illustrated schematically a section of a borehole 10 penetrating a portion of the earth formations 11, shown in vertical section. Disposed within the borehole 10 by means of a cable or wireline 12 is a sampling and measuring instrument 13. The sampling and measuring instrument is comprised of a hydraulic power system 14, a fluid sample storage section 15 and a sampling mechanism section 16. Sampling mechanism section 16 includes selectively extensible well engaging pad member 17, a selectively extensible fluid admitting sampling probe member 18 and bi-directional pumping member 19. The pumping member 19 could also be located above the sampling probe member 18 if desired.

In operation, sampling and measuring instrument 13 is positioned within borehole 10 by winding or unwinding cable 12 from hoist 20, around which cable 12 is spooled. Depth information from depth indicator 21 is coupled to signal processor 22 and recorder 23 when instrument 13 is disposed adjacent an earth formation of interest. Electrical control signals from control circuits 24 are transmitted through electrical conductors contained within cable 12 to instrument 13.

These electrical control signals activate an operational hydraulic pump within the hydraulic power system 14 shown schematically in FIG. 7, which provides hydraulic power for instrument operation and which provides hydraulic power causing the well engaging pad member 17 and the fluid admitting member 18 to move laterally from instrument 13 into engagement with the earth formation 11 and the bi-directional pumping member 19. Fluid admitting member or sampling probe 18 can then be placed in fluid communication with the earth formation 11 by means of electrical controlled signals from control circuits 24 selectively activating solenoid valves within instrument 13 for the taking of a sample of any producible connate fluids contained in the earth formation of intent.

Figure 2:
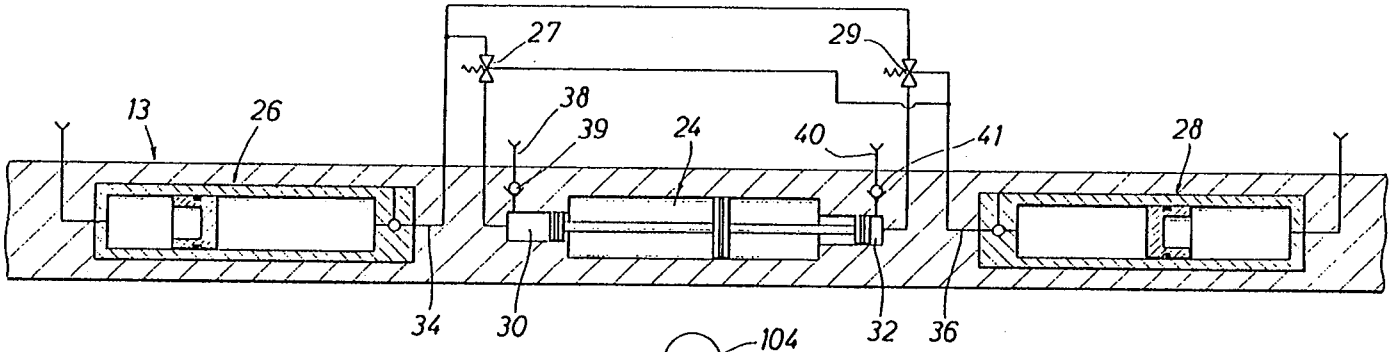
Figure 3:
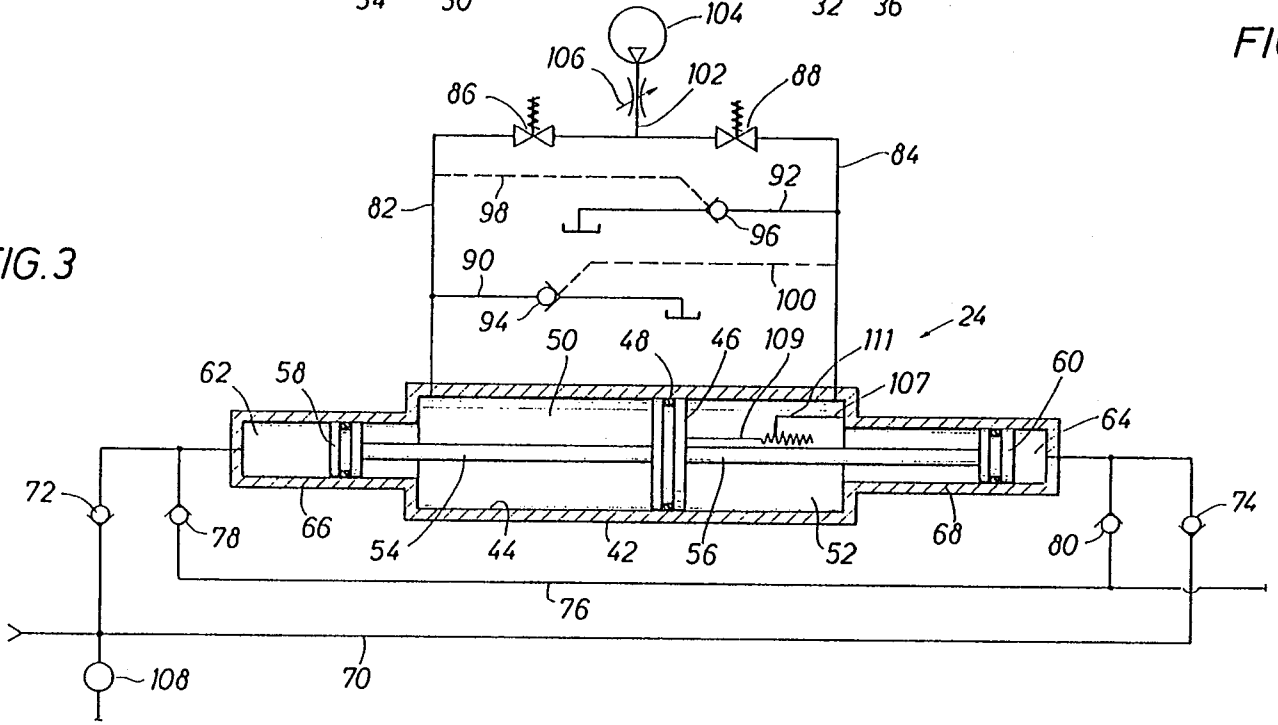

As illustrated in the partial sectional and schematic view of FIG. 2, the formation testing instrument 13 of FIG. 1 is shown to incorporate therein a bi-directional piston pump mechanism shown generally at 24 which is illustrated schematically, but in greater detail, in FIG. 3. Within the instrument body 13 is also provided at least one and preferably a pair of sample tanks which are shown generally at 26 and 28 and which may be of identical construction if desired. The piston pump mechanism 24 defines a pair of opposed pumping chambers 62 and 64 which are disposed in fluid communication with the respective sample tanks via supply conduits 34 and 36. Discharge from the respective pump chambers to the supply conduit of a selected sample tank 26 or 28 is controlled by electrically energized three-way valves 27 and 29 or by any other suitable control valve arrangement enabling selective filling of the sample tanks. The respective pumping chambers are also shown to have the capability of fluid communication with the subsurface formation of interest via pump chamber supply passages 38 and 40 which are defined by the sample probe 18 of FIG. 1 and which are controlled by appropriate valving as shown in FIG. 3, to be discussed hereinbelow. The supply passages 38 and 40 may be provided with check valves 39 and 41 to permit overpressure of the fluid being pumped from the chambers 62 and 64 if desired.

As mentioned above, it is one of the important features of the present invention to provide for acquisition of connate fluid in such manner that the sample does not undergo phase separation during its acquisition and handling to the point of laboratory analysis. This feature is accomplished by controlling the pressure of connate fluid drawdown from the formation by the bi-directional pump 24 and controlling introduction of the connate fluid into the sample tank 26 or 28 so that its pressure at any point in time does not fall below the bubble point pressure of the connate fluid sample. This feature is at least in part accomplished by controlling hydraulically energized operation of the bi-directional drawdown pump 24 in accordance with pressure conditions within the well bore at formation level. Referring now to FIG. 3, the bi-directional piston pump mechanism 24 incorporates a pump mousing 42 forming an internal cylindrical surface or cylinder 44 within which is movably positioned a piston 46 which maintains sealed relation with the internal cylindrical surface 44 by means of one or more piston seals 48. The piston 46 separates the internal chamber of the cylinder into piston chambers 50 and 52. From the piston 46 extends a pair of opposed pump shafts 54 and 56 having pump pistons 58 and 60 at respective extremities thereof which are movably received within pump chambers 62 and 64 which are defined by opposed reduced diameter pump cylinders 66 and 68 which are defined by opposed extensions of the pump housing 42. As the pump motor piston 46 is moved in one direction by virtue of hydraulic energization, the pump piston in its direction of movement achieves a pumping stroke while the opposite pump piston achieves a suction stroke to draw fluid into its pump chamber.

The pump chambers are disposed in selective communication with a sample supply line 70 from which connate fluid is transferred from the formation into the pump chambers 62 or 64 as determined by the direction of pump piston movement. The fluid supply line 70 is in communication with the packer or sample probe of the formation testing instrument. The flow of fluid in line 70 is unidirectional, being controlled by check valves 72 and 74. The pump chambers 62 and 64 are also in communication with a pump discharge line 76 which is in communication with one of the sample tanks for filling thereof or in communication with the borehole as determined by appropriate valving, not shown. The fluid flow in line 76 is also unidirectional, being controlled by check valves 78 and 80 respectively.

For operation of the drawdown piston assembly in a manner that prevents phase separation of the connate fluid during drawdown and pumping, a pump motor control feature is provided, whereby the intake and discharge pressures of the bi-directional pump are controlled within a narrow pressure range which is predetermined to prevent phase separation of the connate fluid. In addition, the speed of the piston is measured and can be controlled to prevent phase separation of the connate fluid sample. The pressure in supply line 70 can be monitored with a pressure gage 108 to provide information for controlling pump actuating movement of the pump motor piston 46. For this purpose, the drawdown piston assembly provides for control of the pressure difference between the present sample line fluid pressure and the minimum sample pressure during drawdown. Control of this differential pressure is accomplished via a pressure regulator to control the flow of hydraulic oil moving the pump motor piston 46. For this purpose hydraulic oil supply lines 82 and 84, which communicate respectively with the piston chambers 50 and 52, are provided with solenoid energized control valves 86 and 88 respectively. These supply lines are also provided with discharge or return lines 90 and 92 which include normally closed pilot valves 94 and 96 respectively, which are propped open responsive to pressure communicated thereto by pilot pressure supply lines 98 and 100. Thus, upon pressurization of supply line 82, its pressure is communicated by a pilot line 98 to the pilot valve 96, opening the pilot valve and permitting hydraulic oil in the piston chamber 52 to vent to the sump or reservoir, with the pump motor piston 46 moving toward the pump cylinder 68. The reverse is true with the piston 46 moving in the opposite direction such as by opening of solenoid energized control valve 88.

Hydraulic oil is communicated to the supply lines 82 and 84 by a hydraulic supply line 102 disposed in communication with a source 104 of pressurized hydraulic fluid having its pressure controlled by a pressure regulator 106.

Figure 4:
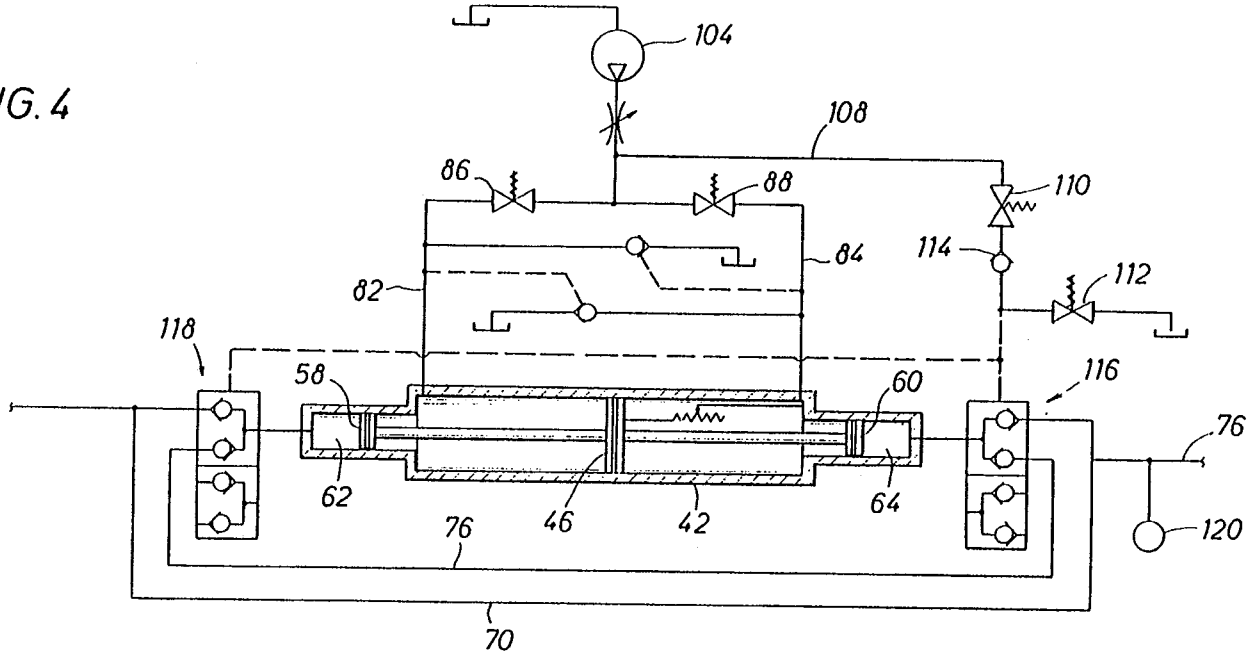

Referring now to FIG. 4, there is shown a simplified schematic illustration of a portion of the downhole instrument to perform pressure-volume-temperature (PVT) measurement down-hole with the wireline formation tester while seated against the formation. In cases where differential sticking is a problem, the sample could be taken into a tank after which the tool can be closed and moved slowly up or down the borehole while PVT analysis is conducted on the fluid in the sampling tank. One of its purposes is to determine the bubble point of fluid/gas samples collected from the formation of interest. It is desirable to measure the volumetric pumping that occurs as the pump piston is cycled. This is accomplished by a linear potentiometer shown generally at 107 which is connected to the pump 24 and which is illustrated schematically by a resistor 109 which is fixed to the piston 46 and a wiper 111 which is fixed to the pump housing 42. A potentiometer circuit 113 is connected to surface electronics to provide a positive display of piston movement. This piston movement is directly translated to movement of the pump pistons 58 and 60. Since the end face area of the pistons 58 and 60 will be known, the volume of fluid pumped by each cylinder of the pump can be accurately computed. Other piston measuerement devices, such as accoustic detectors, magnetic detectors and the like may also be employed to indicate pump piston movement and thus volumetric pumping that occurs as the pump or pumps are cycled. The speed of piston movement can also be controlled by controlling the rate of flow of hydraulic fluid for driving the piston 46 of the plump mechanism. This provides a pressure control feature for the pump to ensure that the sample, especially in the case of indirect pumping, remains at a pressure above its bubble point pressure so that phase separation of the sample does not occur.

Before or after a sufficient amount of formation fluid is purged from the formation into either a tank or to the borehole, the formation testing instrument performs a measurement of pressure, temperature and volume of a finite sample of formation fluid. This is accomplished by the use of the double- acting bi-directional pump mechanism which includes a pump- through capability. The simplified illustration of FIG. 4 discloses a hydraulic operating pressure supply pump 104, representing the hydraulic fluid supply which discharges pressurized hydraulic fluid through a pilot pressure supply conduit 108 under the control of a pair of solenoid valves 110 and 112 together with a check valve 114. These normally closed solenoid valves are selectively operated to direct the flow of hydraulic fluid from the hydraulic pump 104 to a normally open, two-way dirty fluid valve, shown generally at 116 and 118. The dirty fluid check valve assembly, shown in 116 contains two separate check valves which can be interposed between line 70 and 76 and chamber 64, the flow of fluid into chamber 66 is determined by which set of check valves is interposed in the position shown in FIG. 4. When piston 60 is moving to the left, fluid enters chamber 64 from line 70 and when piston 60 is moving to the right fluid is discharged from chamber 64 into line 76. When solenoid valve 110 is actuated to interpose the lower two dirty fluid check valves of check valve assembly 116 between chamber 64 and lines 70 and 76, the fluid flow enters chamber 64 from line 76 when piston 60 moves to the left and fluid is discharged from chamber 64 into line 70 when piston 60 moves to the right. Like pumping action occurs with piston 58, pump chamber 62 and dirty fluid check valve assembly 118. The selective flow of fluid to a sample collection tank or the borehole is thus controlled by positioning the dirty fluid check valve assemblies 116 and 118 in coordination.

Figure 5:
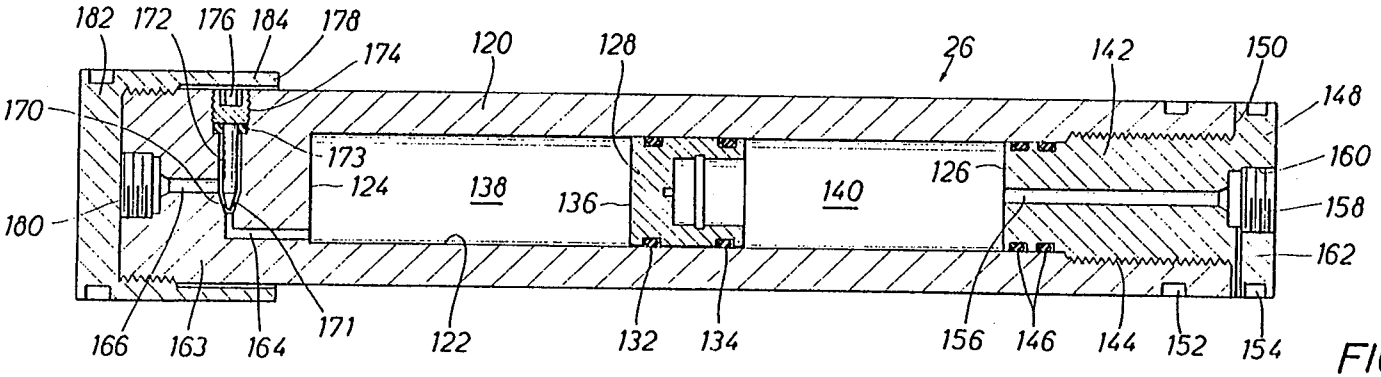

As mentioned above in connection with FIG. 2, it is desirable to accomplish filling of the sample tank 26 without causing or allowing the pressure of the fluid sample to decrease below the bubble point of the connate fluid. This is achieved by pumping fluid by means of the bi-directional piston pump 24 into a sample tank that is pressure balanced with respect to the fluid pressure of the borehole at formation level. The sample tank illustrated schematically in FIG. 2 and in detail in FIG. 5 accomplishes this feature. As shown, the sample tank 26 incorporates a tank body structure 120 which forms an inner cylinder defined by an internal cylindrical wall surface 122 and opposed end walls 124 and 126. A free floating piston member 128 is movably positioned within the cylinder and incorporates one or more seal assemblies as shown at 132 and 134 which provide the piston with high pressure containing capability and establish positive sealing engagement between the piston and the internal cylindrical sealing surface 122. The seals 132 and 134 are typically high pressure seals and thus provide the sample tank with the capability of retaining a connate fluid sample at the typical formation pressure that is present even in very deep wells. The piston 128 is a free floating piston which is typically initially positioned such that its end wall 136 is positioned in abutment with the end wall 124 of the cylinder. The piston functions to partition the cylinder into a sample containing chamber 138 and a pressure balancing chamber 140. When the sample tank is full, the piston will be seated against a support shoulder 126 of a closure plug 142. In this supported position the piston will function as an internal tank closure and will prevent leakage of fluid pressure from one end of the sample tank.

While the end wall 124 of the cylinder is typically integral with the sample tank structure, the end wall 126 is defined by an externally threaded plug 142 which is received by an internally threaded enlarged diameter section 144 of the sample tank housing 120. The closure plug 144 includes one or more seals such as shown at 146 which establish positive sealing between the closure plug and the internal cylindrical surface 122 of the tank housing. The closure plug forms an end flange 148 which is adapted to seat against an end shoulder 150 of the sample tank housing when the plug is in fully threaded engagement within the housing. The housing and plug flange define a plurality of external receptacles 152 and 154 which are engaged by means of a spanner wrench or by any other suitable implement that enables the closure plug 142 to be tightly threaded into the sample tank body or unthreaded and withdrawn from the sample tank body as the case arises.

The sample tank plug 142 defines a pressure balancing passage 156 which may be closed by a small closure plug 158 which is received by an internally threaded receptacle 160 that is located centrally of the end flange 148. While positioned downhole, the closure plug 158 will not be present, thereby permitting entry of formation pressure into the pressure balancing chamber 140. To insure that there is no pressure build- up within the chamber 140 as the closure plug 158 is threaded into its receptacle, a vent passage 162 is defined in the end flange of the closure plug 142 which serves to vent any air or liquid which may be present within the closure plug receptacle.

The end wall structure 163 of the tank housing 120 defines a valve chamber 164 to which is communicated a sample inlet passage 166. A tapered internal valve seat 170 therefor, defined atone end of the valve chamber 164, is disposed for sealing engagement by a correspondingly tapered valve extremity 171 of a valve element 172. The valve element 172 is sealed with respect to the tank body 120 by means of an annular sealing element 173 which is secured within a seal chamber above the valve element by means of a threaded seal retainer 174. In order to permit introduction of a connate fluid sample into the sample chamber 138, the valve element 172 must be in its open position such that the tapered valve extremity 171 is disposed in spaced relation with the tapered valve seat 170. As the connate fluid sample is introduced into the sample chamber 138, a slight pressure differential will develop across the piston 128 and, because it is free-floating within the cylinder, the piston will move toward the end surface 126 of the closure plug 142. When the piston has moved into contact with the end surface 126 of the closure plug, the sample chamber 138 will have been completely filled with connate fluid. The high pressure seals of the piston allow the sample to be overpressured to maintain a pressure level within the sample tank above the bubble point pressure of the sample upon cooling of the sample tank and its contents. Thus, the high pressure containing capability of the piston seals, even under a condition of overpressure, will prevent leakage of the sample fluid from the sample chamber to the pressure balancing passage. The piston thus also serves as an end seal for the sample tank.

The downhole multi-tester instrument will maintain the preestablished pressure of the sample chamber while the instrument is retrieved from the well bore. Prior to release of this predetermined pressure upstream of the sample chamber, the valve element 174 will be moved to its closed and sealed position bringing the tapered end surface 172 thereof into positive sealing engagement with the tapered valve seat surface 170. Closure of the valve element 174 is accomplished by introducing a suitable tool, such as an allen wrench for example, into a drive depression 176 of an externally accessible valve operator element 178. After the valve element 174 has been closed, the pressure of the sample chamber 138 will be maintained even though the inlet passage 166 upstream of the valve is vented. The sample tank 126 may be separated from the instrument for transport to a suitable laboratory facility after the upstream portion of the sample inlet passage 166 has been vented. The passage 166 is then isolated from the external environment by means of a closure plug 180 which may be substantially identical to the closure plug 158. Thereafter, an end cap 182 is threaded onto the end of the sample tank to insure protection of the end portion thereof during transportation. The end cap 182 incorporates a valve protector sleeve 184 which extends along the outer surface of the tank body a sufficient distance to cover and provide protection for the valve actuator 178. The cover sleeve portion of the end cap 182 insures that the valve actuator 178 remains inaccessible so that the valve can not be accidentally opened. This feature prevents the potentially high pressure of connate fluid within the sample chamber 138 from being accidentally vented during handling.

Figure 6:
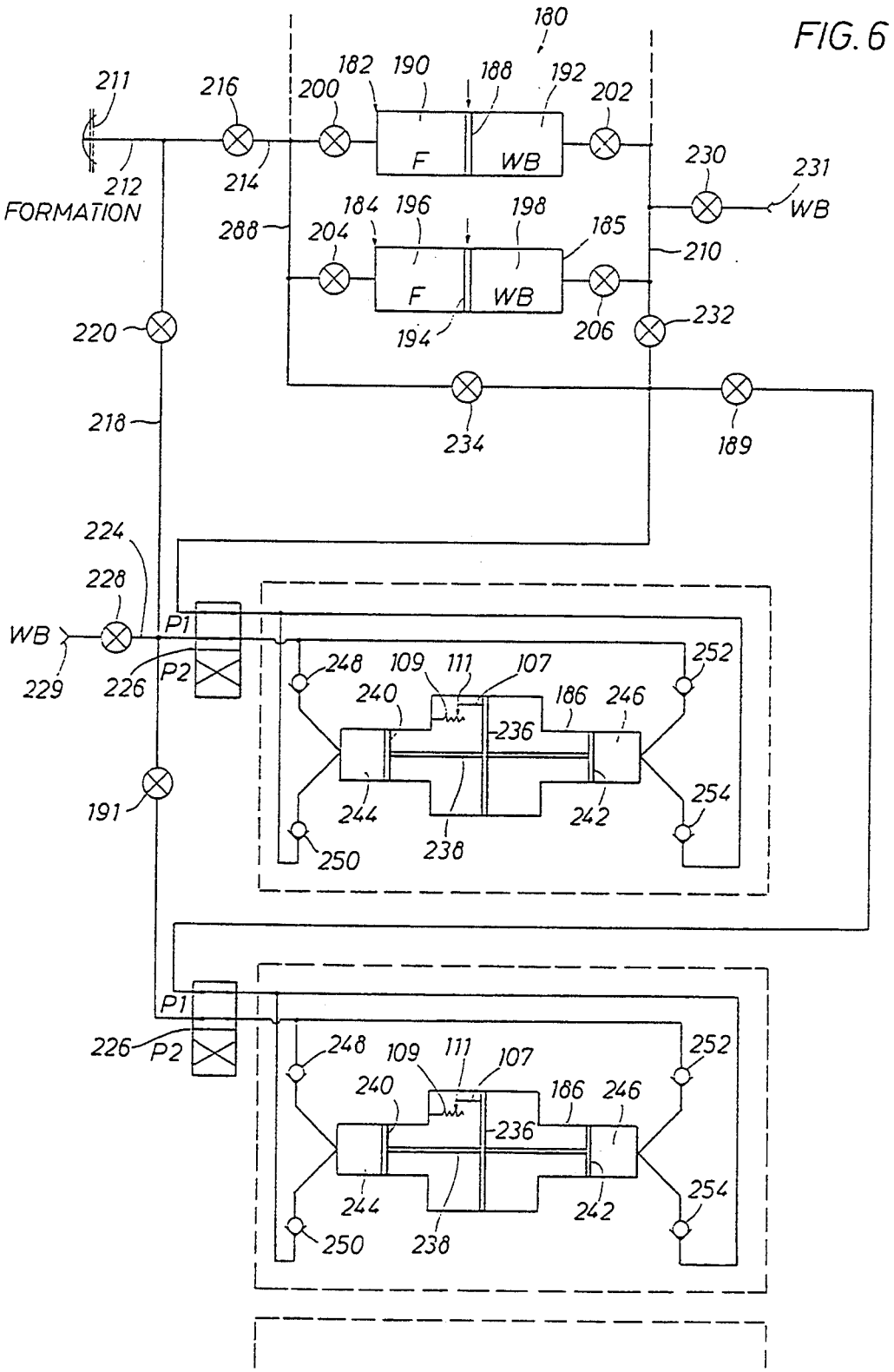

Referring now to FIG. 6 of the drawings a preferred embodiment of this invention is illustrated schematically generally at 180. In this figure there is shown a pair of sample tanks 182 and 184 and a pair of bi-directional pumps 186 and 187. The sample tanks and the bi-directional pumps may conveniently take the form which is illustrated in FIGS. 2–5 without departing from the spirit and scope of this invention. The invention set forth herein differs from that shown in FIGS. 2–5 in an associated valving arrangement which effectively permits selective direct and indirect pumping by means of the bi-directional pumps for pressure controlled collection of samples into selected ones of the sample tanks. Although only two sample tanks 182 and 184 are shown it should be borne in mind that the number of sample tanks is not to be considered controlling from the standpoint of this invention. The invention may employ one or more sample tanks without departing from the spirit and scope of the invention. By "direct" pumping it is meant that the bi-directional pump is employed to draw a sample of connate fluid from the formation and add pressure to the sample to achieve pumping of the sample into the sample tank. In order to compensate for sample pressure loss that occurs due to cooling of the recovered sample as the formation testing instrument is withdrawn from the well bore the pump is caused to increase the pressure of the connate fluid sample to a suitable level above formation pressure that the pressure decrease that occurs upon cooling will not lower the pressure of the sample below its bubble point. By "indirect" pumping the formation pressure itself is employed to achieve movement of the formation fluid into the sample tank. This method allows the sample to be introduced into the sample chamber at formation pressure.

The second bi-directional pump 187 can be essentially a duplicate of pump 186 except that, if desired, its pumping pistons and perhaps also its pump actuation piston may be of differing dimension so that the volumetric pumping capacity of the pump differs from that of pump 186. The second or subsequent bi-directional pump or pumps may be replicated with a second set of tanks to provide a means for higher pumping rates or higher pressures if desired. The second pump may have a different area ratio for pistons 236–240 or 242, thus providing the capability for higher pressures, more cooling or faster pumping for a shorter sampling time. This flexibility allows testing and sampling in widely different permeability formations without necessitating removal of the instrument from the hole. The result amounts to significant time savings especiall in deep wells. The use of multiple pumps allows blending of formation fluids from different zones to simulate the fluid mixing which would occur in producing two formations through the same tubing string and thus forewarns any undesirable precipitation that might be caused by the mixing of differing formation fluids. Control valves 189 and 191 are connected in respective lines to permit pump selection. The pumps 186 and 187 may be operated selectively or operated in concert both in direct and indirect pumping activity. They may also be employed for injection of fluids into the formation and for mixing fluids at the time of injection. These features effectively provide the instrument with a wide range of flexibility so that many different testing and sampling activities may be carried out by appropriate selection at the surface, without necessitating removal of the instrument from the bore hole.

The sample tank 182 is provided with a separator piston 188 which divides the internal volume of the sample tank into a formation fluid volume 190 and a well bore fluid volume 192, these volumes of course being variable as the separator piston, being a floating piston, is moved within the sample tank in response to differential pressure. Likewise, sample tank 184 is provided with a separator piston 194 which divides its volume into a formation fluid volume 196 and a well bore fluid volume 198. During indirect pumping the bi-directional piston type positive displacement pump withdraws fluid, typically well bore fluid, from the well bore fluid volume thus lowering the fluid pressure within the well bore fluid chamber. When this occurs, a pressure differential will exist across the separator piston, permitting formation pressure to move the free piston toward one end of the generally cylindrical tank chamber. The sample chamber of the sample tank will be completely filled when the separator piston comes into contact with the end wall or internal stop of the sample tank.

Communication between the instrument and the formation is established by a formation packer 211 which is set to the bore hole wall and establishes communication with the sample line 212. Remotely controlled sample tank valves 200, 202, 204 and 206 control communication of respective sample tank volumes with a formation fluid line 208 and well bore fluid line 210. These valves, as are other remotely operated valves of the system may conveniently take the form of solenoid valves or pneumatically or hydraulically actuated valves as is suitable to the particular characteristics of the system. A formation fluid supply line 212 is in selected communication with a sample supply line 214 via a control valve 216 and with a pump supply and discharge line 218 via a control valve 220. A supply line 224 for well bore fluid is communicated to a sequence valve 226 when a control valve 228 of the well bore fluid supply line is open. The sequence valve is a two position reversing valve having P1 and P2 positions as indicated in FIG. 6.

The well bore fluid volumes 192 and 198 of the sample tanks are in fluid communication with the well bore when the control valves 202 and 206 are open and a well bore fluid supply valve 230 is also open. A control valve 232 in well bore fluid supply line 210 is opened to connect a respective pump cylinder of the bi-directional pump 186 through the sequence valve 226. Control valve 234 functions as a routing valve to permit communication of pumped formation fluid to the chamber volumes 190 and 196 assuming their respective inlet valves 200 and 204 are open.

As mentioned above, the bi-directional pump mechanism 186 is typically of the character set forth in FIGS. 2–5. It will incorporate a driven piston 236 fixed to a pump shaft 238 with pump pistons 240 and 242 disposed for drawing fluid into the respective pump chambers 244 and 246 or expelling pressure from the pump chambers depending upon the direction of piston movement. A motion sensor, such as a linear measurement potentiometer is also provided to measure the piston position at all times and therefore the displaced volume is known at all times. Measurement of the piston position during its movement establishes the volumetric rate of flow produced by the pump. Pump inlet and discharge is controlled by a plurality of check valves 248, 250, 252 and 254 which assist in routing inlet or pumped fluid through sequence valve 226.

For direct pumping, sample tank and valve operation will be as follows: Once the formation tester instrument has been set and prior to collecting a sample, all valves are closed for simplifying the operational sequence. For filling the sample tank 184 control valves 204 and 232 are opened to allow well bore fluid in sample tank volume 198 to exit to the well bore 231. Formation fluid will then enter the pump through previously opened control valve 220 and through the sequence valve 226 at the P2 position thereof. The bi-directional pump 186 is then appropriately cycled and applies work directly to the fluid routing through open valve 234 to the inlet control valve 204 which is also open to permit filling of the sample tank volume 196. As this occurs the floating separator piston 194 will be shifted to the right in response to differential pressure until the separator piston establishes contact with the end wall 185 of the sample tank. This displaced volume is measured by the continuous measure of piston movement of the known area of piston face 240 and 242. After this has occurred the sample tank filling operation will have been completed so that the sample tank volume 196 constitutes substantially the entire volume of the sample tank. At this point control valves 204 and 206, when opened, will be closed thus sealing the sample tank at the particular pressure that is controlled by the energy of the pump 186. As mentioned above, to prevent phase separation of the sample fluid the pressure of the sample within the sample tank volume 196 can be elevated to a calculated level above well bore pressure. As the sample then begins to cool as the testing and sampling instrument is removed from the well bore any decrease in sample pressure that occurs upon cooling will be compensated for by the excess pump pressure and the sample fluid, remaining above its bubble point pressure, will remain phase intact until sample phase analysis is conducted at some later time. Filling of the sample volume 190 of sample tank 182 is conducted in the same manner as described above. As shown in broken lines the formation fluid sampling instrument may include as many sampling tanks as is desired.

As mentioned above the "indirect" pumping of well bore fluid which is permitted by the valving arrangement described above permits the fluid sample to be introduced into the sample chamber substantially at formation pressure. Before lowering the formation testing instrument into the well bore actuated valves 216, 230, 232 and 228 will have been opened. As the formation testing instrument is lowered into the borehole, well bore fluid enters volumes 192 and 198 of the sample tanks prior to collecting a sample. Separator pistons 188 and 194 are prepositioned at the extreme "left" end of the respective sample tanks to minimize air or other contaminants from combining with subsequently collected sample fluid. This allows the separator pistons 188 and 194 to remain bottomed out prior to collecting a sample utilizing the bi-directional pump 186. Well bore fluid is identified for convenience but other fluids could be employed in volumes 192 and 198 of the sample tanks for the pumping medium.

Collection of the sample is initiated with the sequencing valve 226 positioned as shown in FIG. 6. One or more sample tanks can be chosen with two sample tanks being shown in the figure. Additional sample tanks are indicated by dotted lines. The sampling procedure will be described as follows in connection with the filling of sample tank volume 196 of sample tank 184.

After the formation testing instrument has been set and prior to collecting a sample, all valves are closed for simplifying the sample collection operational sequence.

Considering the filling of only sample tank 184 by indirect pumping, control valves 216 and 204 are opened to allow formation fluid into the sample tank 184. Unless otherwise stated, all other valves are closed. Valves 206 and 232 are then opened to connect the bi-directional pump 186 through the sequence valve 226 at position P1 to the fluid in sample tank volume 198. Control valve 228 is also opened at this time to permit well bore fluid from sample tank volume 198 to be expelled to the borehole 229 on the exhaust stroke of the pump 186. Next, the sequencing valve 226 is shifted to its P1 position as shown in FIG. 6, thus permitting the pump 186 to lower the pressure in sample tank volume 198 and thus allowing formation fluid to flow into the sample tank volume 196 responsive only to formation fluid. Thus the formation fluid entering tank chamber 196 will be substantially at formation pressure and thus will remain phase intact. The double acting piston pump 186 is then appropriately cycled continuously until sample tank volume 198 is depleted and its separator piston 194 will have moved to the right sufficiently for engagement with the end wall 185. At this point the sample tank will be filled with formation fluid and sample tank volume 196 will have expanded to its maximum extent. The displacement of the volume in chamber 198 is confirmed by measurement with a linear potentiometer or other suitable piston movement measurement device. Actuation of the bi-directional pump may then be continued so as to the cause the pressure in sample tank volume 198 to decrease below the bubble point pressure of the sample fluid without causing a further drop in the pressure of the sample fluid of sample tank volume 196 and thus avoiding phase separation of the sample. At this point the sample tank filling operation will have been completed. The sample tank valves 204 and 206 are then closed to secure the sample within the sample tank substantially at formation pressure.

The next sampling tank of the formation fluid sampling instrument can then be filled in like manner by operation of the appropriate control valves. Selection of the "direct" or "indirect" pumping procedures of the instrument is accomplished simply by selective positioning of the sequence valve at the P1 or P2 positions thereof together with appropriate positioning of various other valve of the fluid sample collection circuits of the instrument.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

We claim:

1. A method of acquiring a phase intact connate fluid sample from a subsurface earth formation for subsequent analysis, by means of a formation testing and sampling instrument having at least one pressure containing sample tank with a movable internal fluid separator there;in defining first and second variable volume fluid chambers within said sample tank and having pump means in selective communication with said variable volume fluid chambers of said sample tank, said method comprising:

(a) positioning said formation testing instrument within a well bore with said first variable volume fluid chamber in fluid receiving communication with the formation;

(b) operating said pump for lowering the fluid pressure within said second variable volume fluid chamber and transferring fluid from said second variable volume fluid chamber; and (c) permitting flow of a connate fluid sample from said formation into said sample tank by formation pressure thus filling said first variable volume chamber with said connate fluid sample while maintaining sample pressure thereof substantially at formation pressure.

2. The method of claim 1, wherein said sample tank is disposed in removable assembly with said formation testing instrument, said method further comprising:

(a) removing said formation testing instrument from said well bore;

(b) separating said sample tank from said formation testing instrument; and (c) transporting said sample tank to a laboratory facility for said analyzing said connate fluid sample.

3. The method claim 1, wherein said formation testing and sampling instrument incorporates a plurality of separately operated pumps, said operating said pump means further comprising:

selectively operating said pumps for volumetric controlled pumping of fluid from said second variable volume fluid chamber and controlling the pressure condition within said second variable volume chamber.

4. The method claim 3, wherein said plurality of separately operated pumps are of differing volumetric pumping capacity, said method further comprising:

selectively activating said plurality of pumps according to the volumetric pumping capacity that is desired.

5. The method of claim 1, further comprising:

(a) measuring the speed of piston movement of said pump means; and (b) moving said piston at a speed accomplishing pumping while preventing phase separation of said connate fluid sample being pumped.

6. The method of claim 1, wherein said sample tank is disposed in removable assembly with said formation testing instrument, said method further comprising:

(a) removing said formation testing instrument from said well bore;

(b) separating said sample tank from said formation testing instrument, and (c) analyzing said connate fluid sample thereof.

7. The method of claim 1, wherein said sample tank is in removable assembly with said formation testing instrument and incorporates a fluid inlet and a fluid outlet each having an inlet shut-off valve and said formation testing instrument incorporates a connate fluid supply conduit in separable communication with said sample tank and having a fluid supply control valve, said method including:

(a) prior to said recovery of said formation testing instrument, closing said fluid supply control valve to maintain said connate fluid sample at formation pressure during said recovery;

(b) after said recovery of said formation testing instrument, closing said fluid inlet and outlet shut-off valves of said sample tank;

(c) after closing said inlet and outlet shut-off valves, bleeding connate fluid pressure upstream of said inlet shut-off valve; and (d) removing said sample tank from said formation testing instrument for analyzing said connate fluid sample.

8. The method of claim 1, wherein said operating said pump comprises:

sequentially withdrawing said fluid from said second variable volume chamber so that the pressure change of said connate fluid during flow thereof from said formation into said first variable volume fluid chamber is maintained within a range that prevents phase separation thereof.

9. The method of claim 8, wherein said pump is a hydraulically energized piston pump having at least one positive displacement pumping chamber having a piston therein and being in communication with said formation and said sample tank via a fluid flow passage system having valving and said sample tank is of elongate configuration defining opposed end walls, said method further comprising:

(a) initiating filling of said sample tank with said tank separator located in contact with one of said end walls; and (b) reciprocating said piston and operating said valving to control piston induced unidirectional flow of fluid from said second variable volume fluid chamber, said connate fluid flowing from said formation into said first variable volume fluid chamber under formation pressure and moving said tank separator toward the other of said end walls of said sample tank until said tank separator has moved into contact with said other of said end walls.

10. The method of claim 9 including:

controlling reciprocating pumping movement of said piston responsive to the difference between formation pressure and minimum sample pressure during pumping of fluid from said second fluid chamber.

11. The method of claim 10, wherein said controlling comprises:

regulating the pressure of hydraulic fluid being introduced into said piston pump for controlling the velocity of movement of said piston.

12. A formation testing and sampling instrument for acquisition of a phase intact sample of connate fluid from a subsurface formation of interest being intersected by a well bore, comprising:

(a) means on said formation testing instrument for establishing fluid communication with said subsurface formation and defining a fluid sample circuit and a fluid exhaust circuit;

(b) sample tank means being located within said formation testing and sampling instrument and having a movable internal separator piston separating said sample tank into first and second variable volume fluid chambers, said first variable volume fluid chamber being in selective communication with said fluid sample circuit and said second variable volume fluid chamber being in selective communication with said fluid exhaust circuit;

(c) positive displacement piston type drawdown pump means being disposed within said instrument and having a pumping chamber in selective communication with said fluid exhaust circuit, said drawdown pump being operative for drawing fluid from said second variable volume chamber and permitting tank separator piston movement within said sample tank responsive to formation pressure and pumping said fluid from said fluid exhaust chamber into said bore hole.

13. The formation testing and sampling instrument of claim 12, further comprising:

(a) means for controlling said drawing and pumping of said fluid from said second variable volume chamber within a predetermined pressure range that is sufficient to prevent phase separation of said connate fluid flowing into said first variable volume chamber by formation pressure; and (b) means for sealing said sample tank and thus maintaining the formation pressure of said connate fluid within said first variable volume chamber of said sample tank during withdrawal of said instrument from said well bore.

14. The formation testing and sampling instrument of claim 12, further comprising:

means permitting filling of said second variable volume fluid chamber with ambient fluid at borehole pressure prior to acquisition of said connate fluid sample by said first variable volume chamber from said subsurface formation.

15. The formation testing and sampling instrument of claim 12, wherein said sample tank comprises:

(a) an elongate generally cylindrical sample tank having an internal cylindrical surface and defining first and second end walls (b) said movable tank separator being a free piston within said sample tank being sealed with respect to said internal cylindrical surface, said free piston separating said sample tank into a variable volume sample chamber and a variable volume pressure controlling chamber, said variable volume pressure controlling chamber being in pump controlled communication with ambient pressure;

(c) a connate fluid sample inlet passage being defined by sample tank and being in valve controlled communication with said variable volume sample chamber;

(d) a fluid exhaust passage being defined by said sample tank and being in valve controlled communication with said variable volume pressure controlling chamber; and (e) means within said sample tank for sealing said connate fluid sample inlet passage after filling of said variable volume sample chamber of said sample tank.

16. The formation testing and sampling instrument of claim 15, wherein said means within said sample tank for sealing said sample fluid inlet passage comprises:

a high pressure containing valve being disposed within said sample tank and being movable to an open position for admitting the fluid sample into said sample chamber and to a closed position for blocking said sample inlet.

17. The formation testing and sampling instrument of claim 16, wherein:

said pressure containing tank valve is a manually operable valve which is closed while sample pressure is being maintained by said formation testing and sampling instrument.

18. The formation testing and sampling instrument of claim 17, wherein:

said formation testing and sampling instrument includes a sample inlet vent control permitting selective venting of said sample inlet upstream of said high pressure containing tank valve after closure thereof to permit separation of said sample tank from said formation testing and sampling instrument for transportation to a laboratory facility.

19. The fort-nation testing and sampling instrument of claim 12, wherein said sample tank means comprises:

(a) a plurality of sample tanks being located within said formation testing and sampling instrument; and (b) fluid circuitry within said formation testing and sampling instrument permitting selective filling of said sample tanks.

20. The formation testing and sampling instrument of claim 12, wherein said pump means comprise;s:

(a) a plurality of positive displacement pumps bheing located withins aid formation testing and sampling instrument; and (b) fluid operating circuitry for said plurality of positive displacement pumps, permitting selective actuation thereof.

21. The formation testing and sampling instrument of claim 20, wherein said plurality of positive displacement jpumps are of differing volumetric pumping capacity to permit selective volumetric pumping as desired.

22. The formation testing and sampling instrument of claim 12, wherein:

said means controlling said drawing and pumping by said pump being a flow reversing sequence valve connected with said pressure and exhaust circuits and having a first operative position for drawing connate fluid from said formation by said pump and directly pumping said connate fluid into said first variable volume fluid chamber of said sample tank and having a second operative position for drawing fluid from said second variable volume fluid chamber of said sample tank by said pump and thus permitting indirect sample collection by flow of connate fluid from said formation into said first variable volume fluid chamber by formation pressure.

23. A formation testing and sampling instrument for acquisition of a sample of connate fluid at formation pressure from a subsurface formation of interest being intersected by a well bore, comprising:

(a) means on said formation testing instrument for establishing fluid communication with said subsurface formation and defining a fluid sample circuit and a fluid exhaust circuit;

(b) at least one elongate generally cylindrical sample tank defining first and second tank ends and being located within said sampling instrument and having a movable internal separator piston separating said sample tank into first and second variable volume fluid chambers, said first variable volume fluid chamber being in selective communication with said fluid sample circuit and said second variable volume fluid chamber being in selective communication with said fluid exhaust circuit;

(c) a positive displacement piston type pump being disposed within said instrument and having at least one pumping chamber in selective communication with said fluid sample circuit and with said fluid exhaust circuit, said positive displacement piston type pump being selectively operative for direct sample pumping by drawing connate fluid from said formation and pumping said formation fluid into said first variable volume fluid chamber and being selectively operative for indirect sample collection in said first variable volume chamber by drawing fluid from said second variable volume chamber and permitting tank separator piston movement within said sample tank by connate fluid filling of said first variable volume fluid chamber responsive to formation pressure.

24. The formation testing and sampling instrument of claim 23, further comprising:

control valving within said formation testing and sampling instrument for selecting direct and indirect pumping capability of said instrument.

* * * * *